US005348403A

United States Patent [19]

Mizutani et al.

[11] Patent Number: 5,348,403

[45] Date of Patent: Sep. 20, 1994

[54] INK RIBBON CASSETTE

[75] Inventors: Minoru Mizutani; Norihisa Isaka, both of Tokyo, Japan

[73] Assignee: Oki Electric Industry Co., Ltd., Tokyo, Japan

[21] Appl. No.: 70,427

[22] PCT Filed: Dec. 17, 1991

[86] PCT No.: PCT/JP91/01723

§ 371 Date: Jun. 8, 1993

§ 102(e) Date: Jun. 8, 1993

[87] PCT Pub. No.: WO92/11140

PCT Pub. Date: Sep. 7, 1992

[30] Foreign Application Priority Data

Dec. 25, 1990 [JP] Japan ..... 2-401623[U]

[51] Int. Cl.[5] ..... B41J 32/02; B41J 31/14

[52] U.S. Cl. ..... 400/196; 400/197; 400/194

[58] Field of Search ..... 400/194–197, 400/200, 202–202.4

[56] References Cited

FOREIGN PATENT DOCUMENTS

| | | |
|---|---|---|
| 2544666 | 6/1983 | France . |
| 58-125058 | 8/1983 | Japan . |
| 60-123253 | 8/1985 | Japan . |
| 63-84362 | 6/1988 | Japan . |

*Primary Examiner*—Edgar S. Burr
*Assistant Examiner*—Lynn D. Hendrickson
*Attorney, Agent, or Firm*—Panitch, Schwarze, Jacobs & Nadel

[57] ABSTRACT

An ink ribbon cassette containing an endless ink ribbon (1) and replenishing ink to be supplied to said ink ribbon (1), and intends to stabilize PCS at an early stage of printing. For attaining the purpose, provided is an auxiliary ink supplying member (16, 32 and 42) to be brought into contact with the forward end of an ink supplier (10) for supplying ink in an ink occluding body (11) to a follower gear (7). The auxiliary ink supplying member (16, 32 and 42) is impregnated beforehand with ink to be supplied to the follower gear (7) at an early stage of printing.

2 Claims, 8 Drawing Sheets

INK RIBBON CASSETTE

TECHNICAL FIELD

The present invention relates to an ink replenishing type ink ribbon cassette adapted for use in a serial printer for storing a replenishing ink therein and supplying the replenishing ink to an ink ribbon by an ink supplier.

BACKGROUND TECHNOLOGY

An ink ribbon cassette containing therein an ink ribbon has been conventionally widely used so that the ink ribbon can be easily mounted on a printer and an operator's hand and the printer are prevented from being contaminated when the ink ribbon is mounted on the printer.

The life of the ink ribbon is in general determined by the amount of ink which is impregnated into the ink ribbon. However, the life of a ground fabric of the ink ribbon is normally longer than that of the ink ribbon. Accordingly, there is proposed an ink ribbon cassette provided with an ink supplying means for supplying ink to the ink ribbon in order to lengthen the life of the ink ribbon.

FIG. 1 is an exploded perspective view of the ink ribbon cassette wherein an upper cover of the ink ribbon cassette and an upper cover of an ink occluding body case are respectively removed, based on which the conventional ink ribbon cassette will be described hereinafter.

In the same figure, an ink ribbon 1, which is endless and looped, is contained in a ribbon containing portion 3 of an ink ribbon cassette 2 and the part of the ink ribbon 1 is exposed outside of the ink ribbon cassette 2 from the forward ends of ribbon guide portions 4a and 4b. The ink ribbon 1 is moved in the direction of the arrow at the exposed portion.

A driving gear 5 is disposed in an inlet of the ribbon containing portion 3 and is rotatably supported by a driving gear supporting member 6.

A follower gear 7 is rotatably supported by a follower gear supporting member 8 and is pressed against the driving gear 5 by a spring 9. Teeth of the follower gear 7 mesh with teeth of the driving gear 5 while clamping the ink ribbon 1 therebetween. An ink supplier 10 formed of felt is brought into contact with the follower gear 7 at one end thereof and contacts an ink occluding body 11 formed of fiber impregnated with ink at the other end thereof so as to draw ink from the ink occluding body 11 owing to the capillary action and to supply ink to the follower gear 7.

An ink occluding body cover 13 is to be attached to an ink occluding body case 12 to prevent ink in the ink occluding body 11 from leaking out.

A ribbon cassette cover 14 accommodates all these components in the ribbon cassette 2 and covers the ink ribbon cassette 2.

With such an arrangement as set forth above, the ink ribbon 1 which is clamped by the driving gear 5 and the follower gear 7 is driven by way of the driving gear 5 when a carriage performs space driving and is circulated and drawn in the ribbon containing portion 3 whereby the ink ribbon I is contained in the ribbon containing portion 3 as it is folded.

The ink ribbon I drawn out from the ribbon containing portion 3 is passed through the ribbon guide portion 4a and is once exposed outside of the ribbon cassette 2 and thereafter printing is performed through the ink ribbon 1. Upon completion of printing, the ink ribbon 1 is passed through the ribbon guide portion 4b and circulated and drawn into the ribbon containing portion 3.

When the ink ribbon I is drawn into the ribbon containing portion 3, ink from the ink supplier 10, which is brought into contact with the follower gear 7, is supplied to the follower gear 7 through which ink is transferred to and replenished to the ink ribbon 1.

However, as illustrated in FIG. 2 showing the relation between the number of printed letters and print density, i.e. print contrast signal (hereinafter referred to as PCS), PCS is lowered at the time A at a relatively early stage of printing. This leads to such a problem that PCS is not stabilized at the time A of the relatively early stage of printing.

The reason why PCS is lowered at the time A is that the amount of ink to be supplied from the ink occluding body 11 to the ink supplier 10 does not overtake the amount of consumption of ink which is impregnated beforehand into the ink ribbon. This is described more in detail with reference to FIG. 3.

FIG. 3 is a graph showing the result of investigation of PCS using individually the ink ribbon and the ink occluding body. Printing by the ink ribbon 1 alone means that the ink supplier 10 is removed and ink in the ink occluding body 11 is not supplied to the ink ribbon 1 while printing using the ink occluding body 11 alone means that a blank ribbon, which is not impregnated with ink, is used. Print density using the ink ribbon 1 alone and the ink occluding body 11 alone are totalled to indicate PCS in FIG. 2. As illustrated in FIG. 3, printing using the ink ribbon 1 alone shows a sharp dropping of PCS while printing using the ink occluding body 11 alone shows that PCS increases between the beginning of printing and five hundred thousand printed letters. Since the intersecting point between the line showing PCS of the ink ribbon 1 alone and the line showing PCS of the ink occluding body 11 alone shows that the number of printed letters are two hundred thousands, the reason why PCS in normal printing in FIG. 2 is lowered between one hundred thousand printed letters and two hundred thousand printed letters and is increased from five hundred thousand printed letters is that PCS using the ink ribbon 1 alone is sharply dropped and PCS using the ink occluding body 11 alone is greater than PCS using the ink ribbon 1 alone after two hundred thousand printed letters and remains increased until five hundred thousand printed letters.

There is known an improvement of another ink replenishing type ink ribbon cassette which is disclosed in a gazette of Japanese Utility Model Laid-Open Publication No. 63-84362. The ink ribbon cassette as disclosed in the gazette has an auxiliary ink supplying member in addition to a main ink supplying member for supplying ink to the ink ribbon wherein the auxiliary ink supplying member can be switched so as to be connected to or disconnected from the main ink supplying member by a switching member. That is, according to this ink ribbon cassette, the thickness of the ink supply route can be switched depending on the amount of ink residual in an ink impregnated body.

However, there are problems in this ink ribbon cassette. That is, firstly, when the auxiliary ink supplying member is forced to contact the main ink supplying member by the switching member after PCS is lowered (at point B) as illustrated in FIG. 4, the amount of ink is sharply reduced thereafter so that PCS is sharply dropped. Secondly, when the auxiliary ink supplying member is forced to contact the main ink supplying member from the beginning of printing, PCS is too high at the early stage of printing as illustrated in FIG. 5 and thereafter PCS is lowered at the relatively early stage of printing, which results in shortening the life of the ink ribbon. Thirdly, since the switching member should be manually operated, the switching operation is troublesome.

Accordingly, it is an object of the present invention to provide an ink ribbon cassette which solves the unstableness of PCS at the early stage of printing without resorting to the manual operation for switching the ink supplying means.

DISCLOSURE OF THE INVENTION

The present invention comprises an endless ink ribbon, a ribbon cassette comprised of a ribbon containing portion for folding and containing the ink ribbon therein and ribbon guide portions for exposing the ink ribbon outside of the ink ribbon cassette from the forward ends thereof, a ribbon feeding mechanism for feeding the ink ribbon from the ribbon guide portions to the ribbon containing portion, an ink supplier for supplying ink from the forward end thereof to the ink ribbon by way of the ribbon feeding mechanism, an ink occluding body for supplying ink to the ink supplier and an auxiliary ink supplying member impregnated beforehand with ink which contacts the forward end of the ink supplier or the ribbon feeding mechanism and is spaced away from the other portion of the ink supplier or the ink occluding body. With such an arrangement, even if ink, which is impregnated beforehand into the ink ribbon, runs out, ink in the auxiliary ink supplying member is supplied to the ribbon feeding mechanism so that the unstableness of PCS in the early stage of printing is solved. Furthermore, it is not necessary to perform the manual switching operation which has been made in the prior art (the gazette of Japanese Utility Model Laid-Open Publication No. 63-84362). Still furthermore, since the auxiliary ink supplying member does not directly contact the ink occluding body, the consumption of ink can be saved, which results in contribution to the long life of the ink ribbon.

BEST MODE FOR CARRYING OUT THE INVENTION

An embodiment of the present invention will be described with reference to drawings. Elements which are common to each drawing are denoted at the same numerals.

Figure 1:
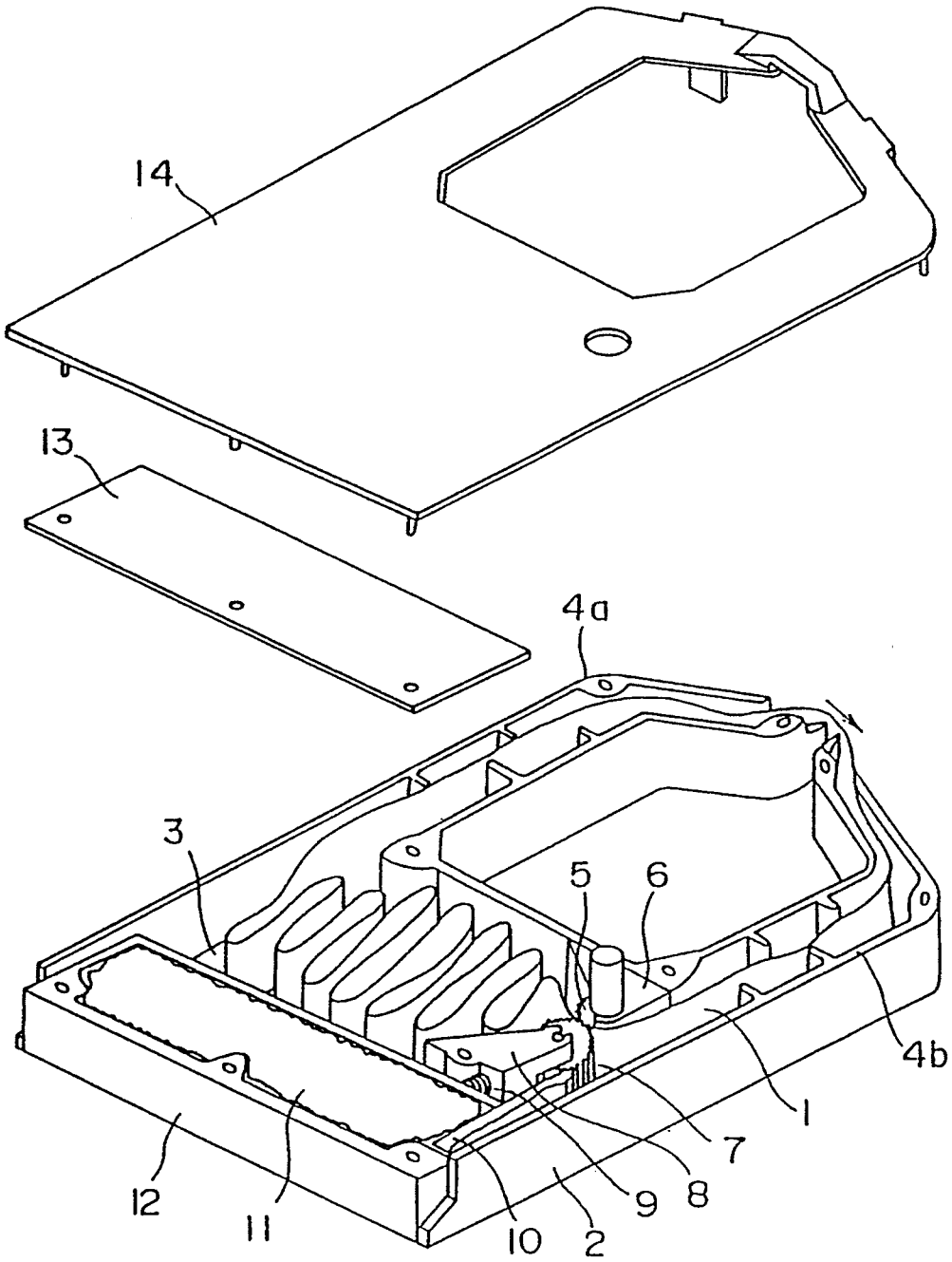
FIG. 1 PRIOR ART
FIG. 1 is an exploded perspective view showing a conventional ink ribbon cassette.
Figure 2:
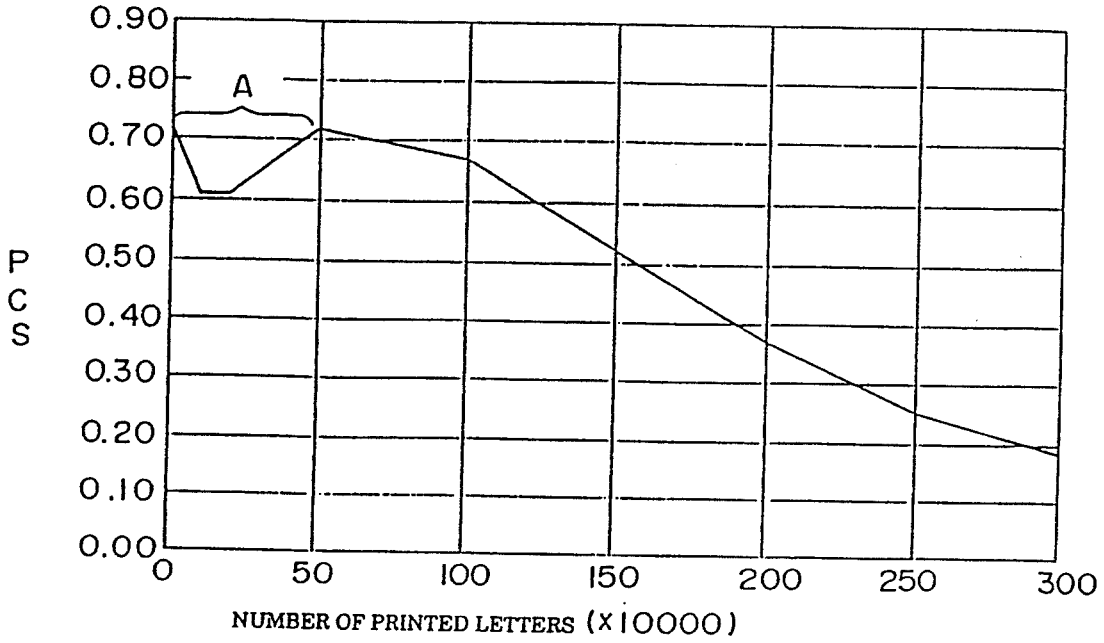
FIG. 2 is a graph showing the relation between the number of printed letters and PCS according to the conventional ink ribbon cassette.
Figure 3:
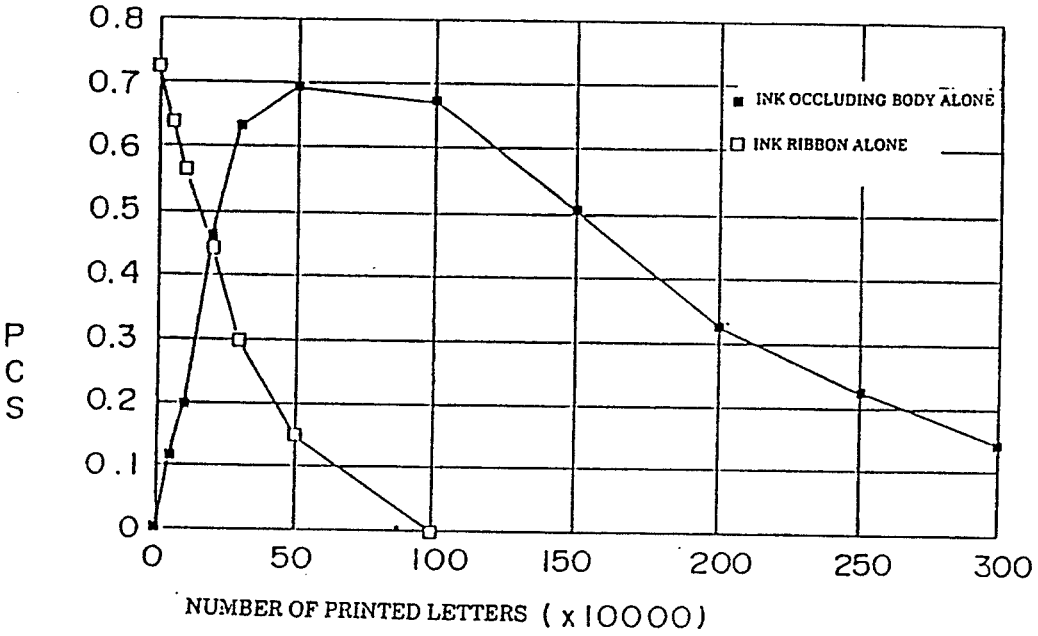
FIG. 3 is a graph showing individually PCS using an ink ribbon alone and PCS using an ink occluding body alone.
Figure 4:
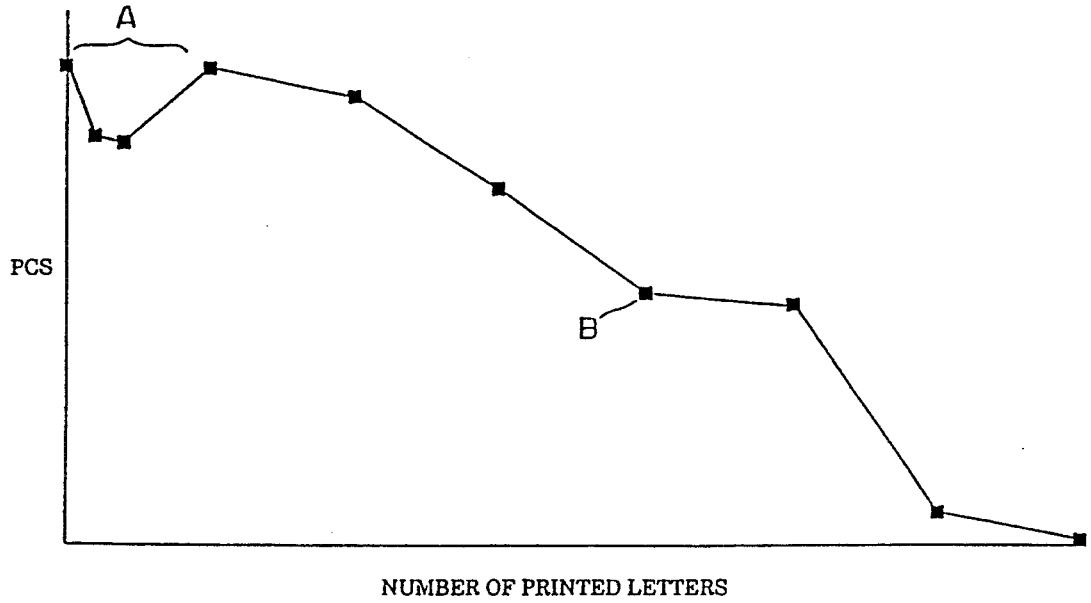
FIG. 4 is a graph showing the relation between the number of printed letters and PCS according to another conventional ink ribbon cassette.
Figure 5:
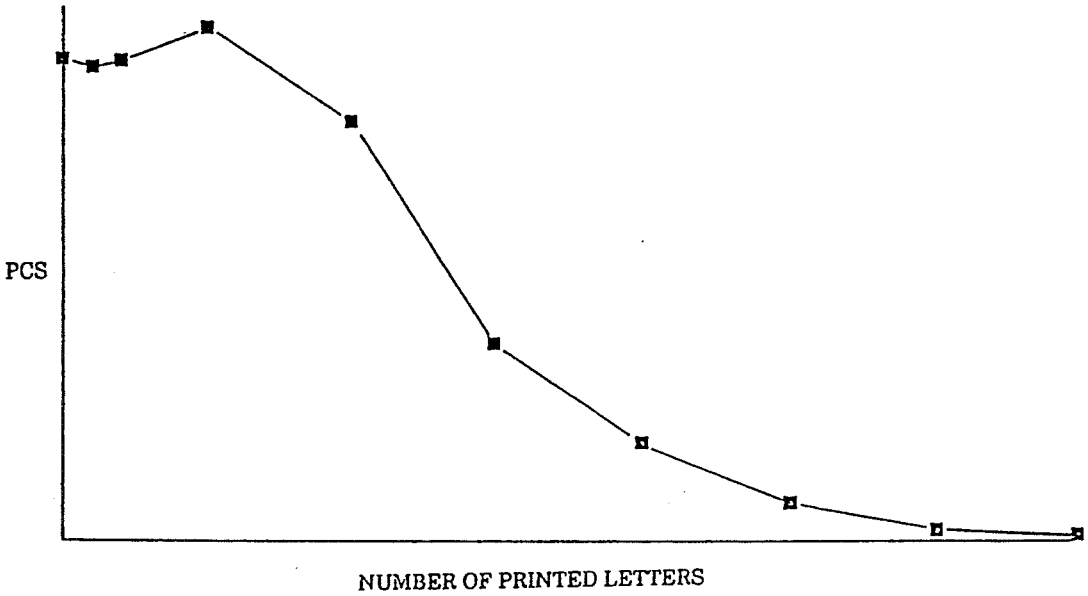
FIG. 5 is a graph showing the relation between the number of printed letters and print density according to still another conventional ink ribbon cassette.
Figure 6:
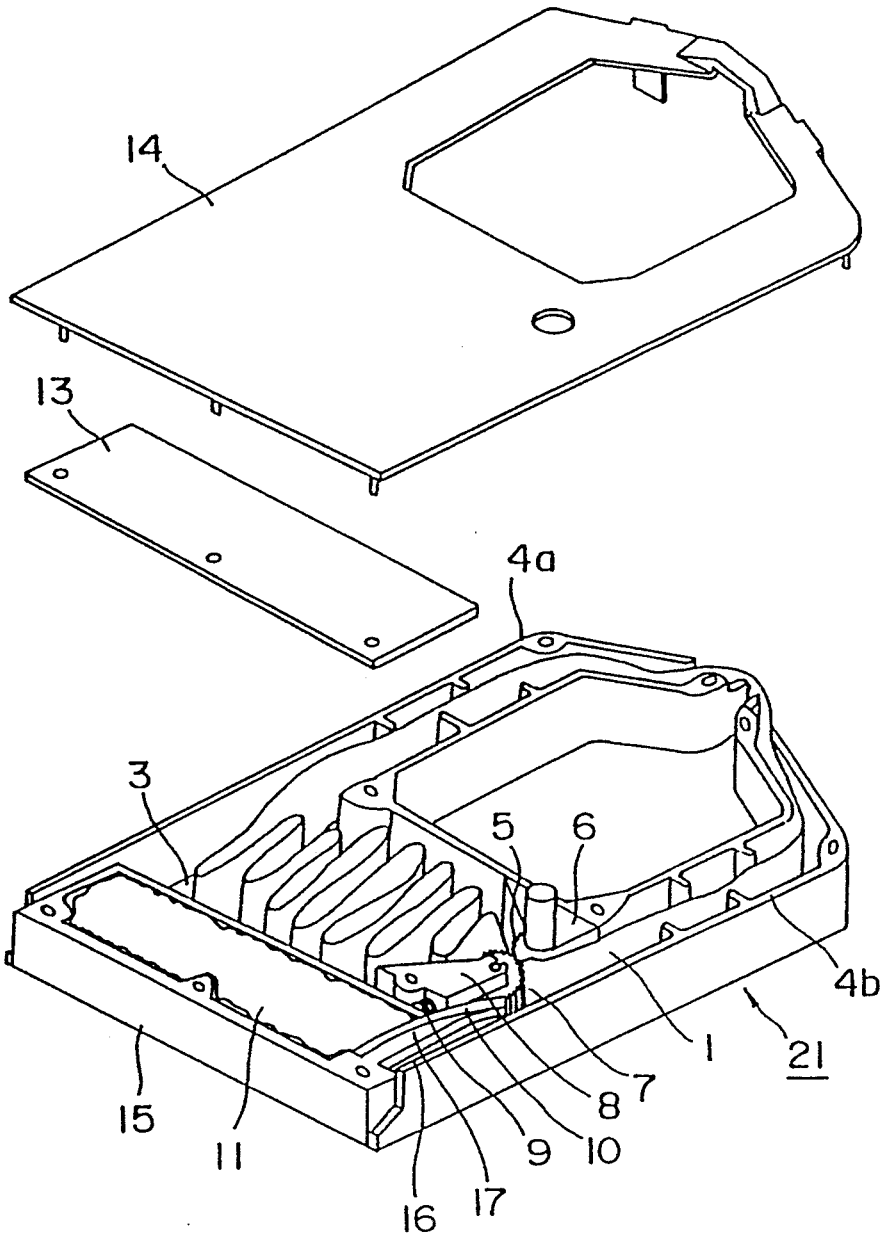
FIG. 6 is an exploded perspective view showing an ink ribbon cassette according to a first embodiment of the present invention.
Figure 7:
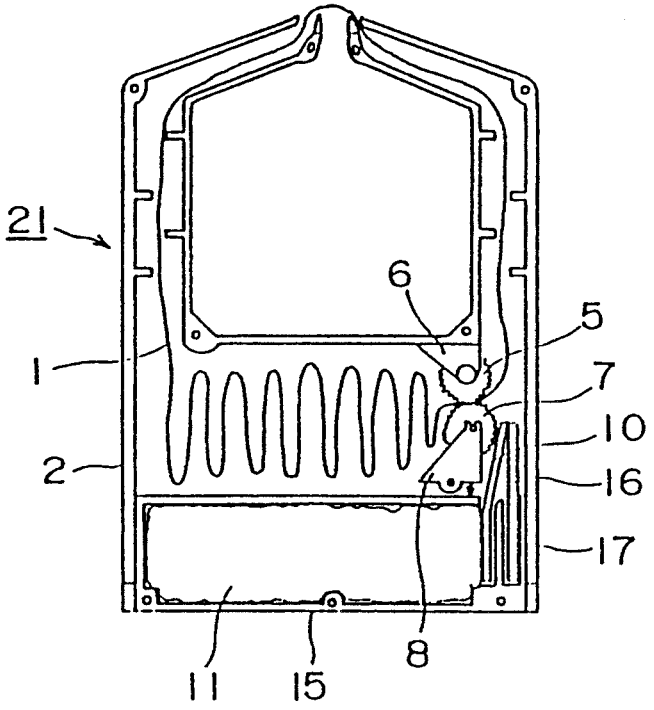
FIG. 7 is a top plan view showing the ink ribbon cassette according to the first embodiment of the present invention.

FIG. 6 is an exploded perspective view showing an ink ribbon cassette according to a first embodiment and FIG. 7 is a plan view of the ink ribbon cassette according to the first embodiment. FIG. 7 shows the state where a cover of the ink ribbon cassette is removed.

In both figures, an ink ribbon cassette 21 according to the first embodiment comprises an ink ribbon 1, a ribbon cassette 2 having an ink ribbon containing portion 3 for containing the ink ribbon 1 therein and ribbon guide portions 4*a* and 4*b*, a ribbon feeding mechanism composed of a driving gear 5, a driving gear supporting member 6, a follower gear 7, a follower gear supporting member 8 and a spring 9, an ink supplier 10 for supplying ink to the follower gear 7, an ink occluding body 11 for supplying ink to the ink supplier 10, an ink occluding body case 15 for containing the ink occluding body 11 therein, an ink occluding body cover 13, an auxiliary ink supplier 16, an ink protecting wall 17 for dividing between the ink supplier 10 and the auxiliary ink supplier 16 and a ribbon cassette cover 14 for covering the ribbon cassette 2 after all the components set forth above are contained in the ribbon cassette 2.

The ink supplier 10 is formed of felt and contacts the follower gear 7 at one end thereof and also contacts the ink occluding body 11 in the ink occluding body case 15 at the other end thereof. The ink occluding body 11 is formed of polyester fiber impregnated with ink. Accordingly, the ink supplier 10 sucks ink from the ink occluding body 11 owing to the capillarity and supplies the ink to the follower gear 7. The auxiliary ink supplier 16 contacts the forward end of the ink supplier 10 at the outside of the ink occluding body case 10. The auxiliary ink supplier 16 is formed of felt like the ink supplier 10 and is beforehand impregnated with ink.

The ink protecting wall 17 is formed between the ink supplier 10 and the auxiliary ink supplier 16 wherein both the ink supplier 10 and the auxiliary ink supplier 16 are prevented from contacting each other at the portion other than the forward ends thereof by the ink protecting wall 17. As a result, ink in the ink occluding body 11 cannot soak into the auxiliary ink supplier 16 but only through the forward end of the ink supplier 10.

The ink occluding body cover 13 is to be attached to the ink occluding body case 15 so as to prevent ink in the ink occluding body 11 from leaking out as illustrated in FIG. 6.

According to the first embodiment having the arrangement as set forth, printing is performed by a print head, not shown, and the driving gear 5 is rotated by a motor, not shown, so that the ink ribbon I is moved in the direction of the arrow in FIG. 6. When the ink ribbon 1 is clamped by the driving gear 5 and the follower gear 7, ink is replenished to the ink ribbon 1 from the follower gear 7.

Figure 8:
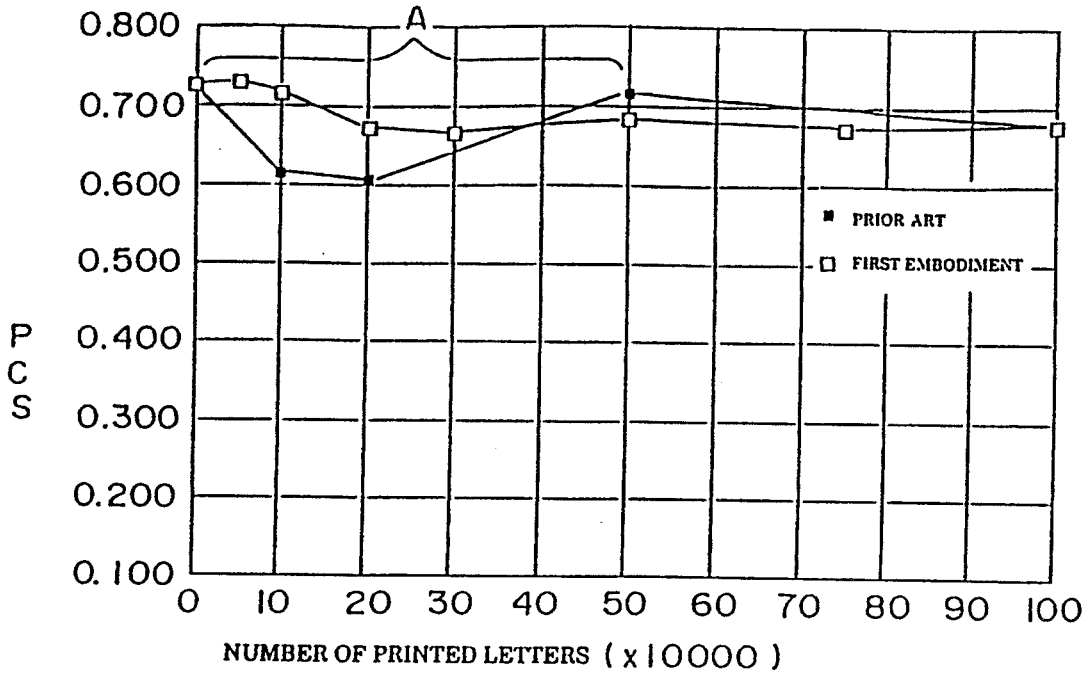
FIG. 8 is a graph showing PCS according to the first embodiment.

Print density at the time of continuous printing according to the first embodiment is illustrated in FIG. 8. As evident from FIG. 8, PCS is scarcely lowered between zero to five hundred thousand printed letters, i.e. at the time A so that high PCS, i.e. 0.7 at the beginning of printing is kept constant. FIG. 8 also illustrates PCS of the prior art to compare both PCS.

The reason why PCS is kept constant at the time A will be described with reference to a test data.

Figure 9:
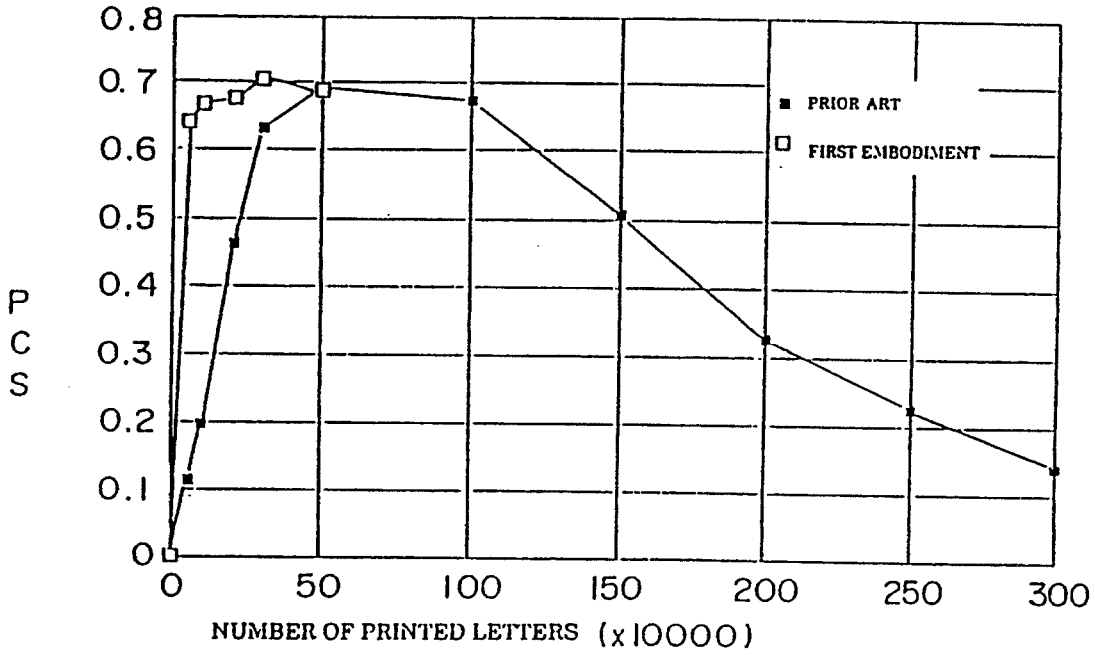
FIG. 9 is a graph showing PCS using a blank ribbon according to the first embodiment.

FIG. 9 shows the result of measurement of PCS using a blank ribbon, namely, the ink ribbon which is not impregnated with ink at all according to the ink ribbon cassette of the first embodiment. In this case, ink is impregnated into the ink supplier 10, the ink occluding body 11 and the auxiliary ink supplier 16. As is evident from FIG. 9, PCS rises relatively quickly up to fifty thousand printed letters according to the ink ribbon cassette of the present embodiment. FIG. 9 also shows PCS using a blank ribbon according to the conventional ink ribbon cassette. It is clear the PCS rises sharp compared with the conventional one. This shows that ink from the auxiliary ink supplier 16 is supplied to the ink ribbon through the ink supplier 10 and the follower gear 7 immediately after the beginning of printing. At the same time, the supply of ink from the ink occluding body 11 is finally full when the number of printed letters reaches five hundred thousands.

Figure 10:
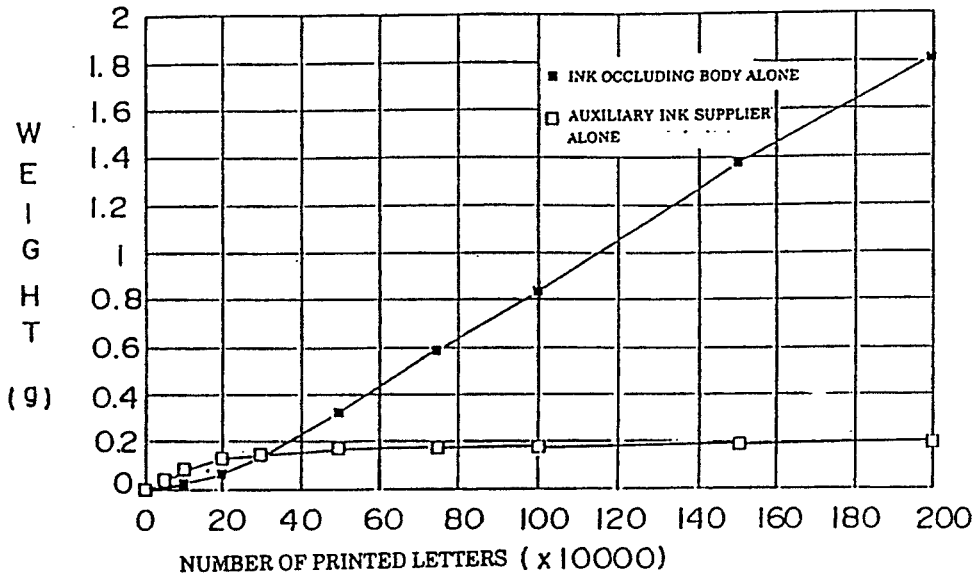
FIG. 10 is a view showing the amount of consumption of ink according to the first embodiment.

FIG. 10 is a graph showing the relation between the amount of consumption of ink and the number of printed letters according to the first embodiment wherein each relation is individually illustrated for the ink occluding body 11 and the auxiliary ink supplier 16. As evident from FIG. 10, the amount of consumption of ink of the ink occluding body 11 is small between the beginning of printing and two hundred thousand printed letters and ink, which is supplied from the auxiliary ink supplier 16, makes up such a small amount of ink.

As is evident from the explanation set forth above, PCS at the early stage of normal printing (time A in FIG. 8) can be kept constant by the supply of ink from the auxiliary ink supplier 16.

Figure 11:
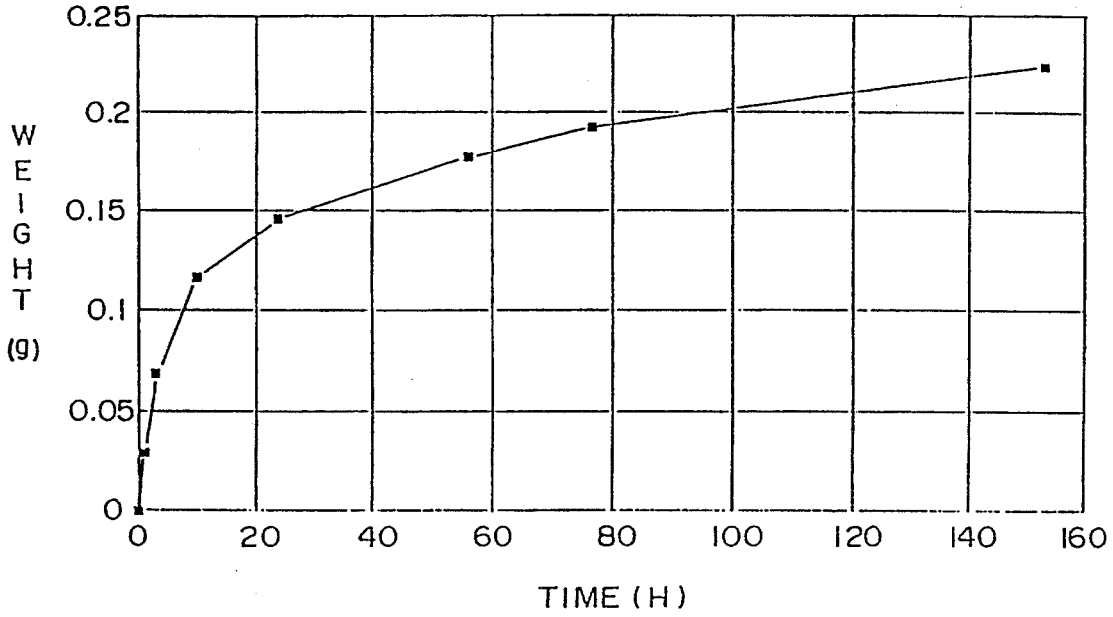
FIG. 11 is a graph showing amount of transmission of ink to an auxiliary ink supplier according to the first embodiment.

When ink from the auxiliary ink supplier 16 is consumed, ink from the ink occluding body 11 is transmitted to the auxiliary ink supplier 16 through the ink supplier 10. FIG. 11 is a graph showing the amount of ink which is transmitted from the ink occluding body 11 to the auxiliary ink supplier 16 in which the amount of transmission of ink is measured for the auxiliary ink supplier 16 which is not impregnated with ink. As evident from FIG. 11, even if ink of the auxiliary ink supplier 16 is consumed by printing, ink is transmitted to the auxiliary ink supplier 16 through the forward end of the ink supplier 10 if the ink occluding body 11 is fully impregnated with ink. According to FIG. 11, half of ink returns to the auxiliary ink supplier 16 after ten hours lapse and ink from the ink auxiliary ink supplier 16 can be supplied to the ink ribbon 1 in the succeeding printing.

Figure 12:
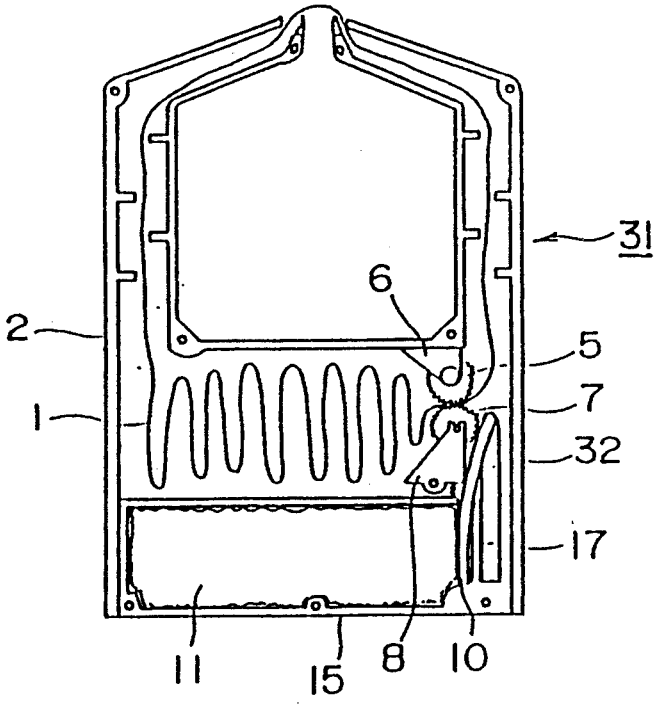
FIG. 12 is a plan view showing an ink ribbon cassette according to a second embodiment of the present invention.

FIG. 12 is a plan view showing a second embodiment of the present invention. An ink ribbon cassette 31 according to the second embodiment is provided with an auxiliary ink occluding body 32 instead of the auxiliary ink supplier in the first embodiment. The auxiliary ink occluding body 32 is formed of the same material as that of the ink occluding body 11, i.e. polyester fiber but may be formed of sponge or natural wool. The auxiliary ink occluding body 32 contacts the ink supplier 10 at the forward end thereof and the ink protecting wall 17 is provided therebetween in the same way as the first embodiment. In the second embodiment having such an arrangement, the same effect as the first embodiment can be obtained as a result of test.

Figure 13:
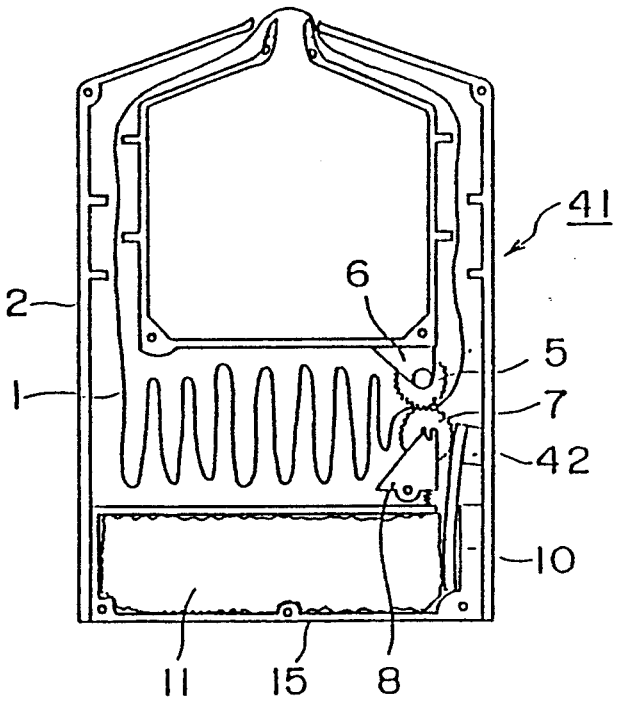
FIG. 13 is a plan view showing an ink ribbon cassette according to a third embodiment of the present invention.

FIG. 13 is a plan view showing a third embodiment of the present invention. In an ink ribbon cassette 41 of the third embodiment, an ink occluding body 42 is attached to the ink supplier 10. The auxiliary ink occluding body 42 is formed of polyester fiber and is attached to the forward end of the ink supplier 10 by an adhesive.

In the third embodiment having such an arrangement, the same effect as the first embodiment can be obtained. In the third embodiment, since the auxiliary occluding body 42 is provided outside of the ink occluding body case 15, the ink occluding body 11 can be enlarged, which results in assuring long life of the ink ribbon cassette 41.

Although the auxiliary ink supplier 16 and the auxiliary ink occluding bodies 32 and 42 are respectively forced to contact the forward end of the ink supplier 10, they are forced to directly contact the follower gear 7 so as to increase the amount of ink to be supplied to the ink ribbon 1. In this case, it is preferable to use felt as the material of the auxiliary ink supplying member.

INDUSTRIAL UTILIZATION

As mentioned above, the ink ribbon cassette according to the present invention is useful for an impact printer, particularly to a wire dot printer and also can be used for a wire dot type line printer.

We claim:

1. An ink ribbon cassette comprising:

an endless ink ribbon;

an ink ribbon cassette composed of an ink ribbon containing portion for folding and containing the ink ribbon therein and ribbon guide portions each having a forward end for exposing the ink ribbon outside of the ink ribbon cassette from the forward ends;

a ribbon feeding mechanism for feeding the ink ribbon from the ribbon guide portions to the ribbon containing portion;

an ink occluding body for storing a replenishing ink therein;

an ink supplier having a forward end, said ink supplier contacting the ink occluding body and extending therefrom to contact the ribbon feeding mechanism at the forward end for supplying the replenishing ink to the ink ribbon by way of the ribbon feeding mechanism; and an auxiliary ink supplying member which is impregnated beforehand with ink and contacts the ink supplier only at the forward end of the ink supplier whereby the auxiliary ink supplying member supplies ink, to the ink supplier or the ribbon feeding mechanism.

2. An ink ribbon cassette comprising:

an endless ink ribbon;

an ink ribbon cassette composed of an ink ribbon containing portion for folding and containing the ink ribbon therein and ribbon guide portions each having a forward end for exposing the ink ribbon cassette form the forward ends thereof;

a ribbon feeding mechanism for feeding the ink ribbon from the ribbon guide portions to the ribbon containing portion;

an ink occluding body for storing a replenishing ink therein;

an ink supplier having a forward end, said ink supplier contacting the ink occluding body and extending therefrom to contact the ribbon feeding mechanism at the forward end for supplying the replenishing ink to the ink ribbon by way of the ribbon feeding mechanism;

an auxiliary ink supplying member which is impregnated beforehand with ink, said auxiliary ink supplying member having an end which contacts the forward end of the ink supplier; and an ink protecting wall provided between the ink occluding body or the ink supplier and the auxiliary ink supplying member for preventing ink in the ink occluding body from soaking into the auxiliary ink supplying member.

* * * * *